US005477983A

United States Patent [19]

Davis

[11] Patent Number: 5,477,983

[45] Date of Patent: Dec. 26, 1995

[54] TRIANGULAR REFILLABLE CRAYON DISPENSER FOR WAX CRAYON

[76] Inventor: Carolyn A. P. Davis, 10612 Linnell Dr., St. Louis, Mo. 63136

[21] Appl. No.: 109,423

[22] Filed: Oct. 8, 1993

[51] Int. Cl.[6] ..... B65G 59/00

[52] U.S. Cl. ..... 221/279; 401/75

[58] Field of Search ..... 221/279, 227, 221/231, 232; 401/176, 180, 68, 75, 79

[56] References Cited

U.S. PATENT DOCUMENTS

| | | | |
|---|---|---|---|
| 2,816,654 | 12/1957 | Fuller et al. | 401/75 |
| 2,980,246 | 4/1961 | Leshir | 401/75 |
| 4,199,311 | 4/1980 | Ferris et al. | 401/180 |
| 4,363,560 | 12/1982 | Genfile | 401/68 |
| 4,699,161 | 10/1987 | Smith et al. | 401/68 |
| 5,067,838 | 11/1991 | Iwase | 401/180 |
| 5,131,777 | 7/1992 | Junji et al. | 401/180 |

*Primary Examiner*—Kenneth Noland
*Attorney, Agent, or Firm*—Frank B. Janoski

[57] ABSTRACT

A dispenser of crayons or the like comprising a container having a longitudinally extending passageway there through. The container has inner and outer walls. The container also has an upper open end and a lower open end for dispensing the crayon or the like. The dispenser further has urging means for moving a crayon in a direction outwardly through the container and the lower open end. In addition, a crayon cartridge is provided with a longitudinal bore there through.

1 Claim, 1 Drawing Sheet

TRIANGULAR REFILLABLE CRAYON DISPENSER FOR WAX CRAYON

BACKGROUND OF THE INVENTION

This invention relates generally to a crayon dispenser and, more particularly to a refillable crayon dispenser for wax crayons.

Heretofore, dispensers for liquids, semi-solids and solids have been known to exist. However, there has not been a dispenser for crayons. At present, crayon users only utilize 50% of a crayon due to breakage or difficulty in handling the crayon after it has been used for a short period of time. In addition, since the crayon itself is used as a holder, it is difficult to use all of the crayon. This makes the use of crayons uneconomical since most of the crayon normally is not used. Furthermore, a mess is created whenever a crayon is accidently stepped on.

SUMMARY OF THE INVENTION

Among the several objects of the invention may be noted the provision of a refillable crayon dispenser which enables the user to use essentially the entire crayon; the provision of a dispenser which minimizes breakage of the crayon; the provision of a dispenser which promotes the proper manner of holding a writing instrument; the provision of a dispenser which provides an improved manner for writing, drawing and coloring with wax crayons; and the provision of a dispenser which is simple and safe to use.

In general, a dispenser for crayon or the like comprises a container having a longitudinally extending passageway therethrough. The container has inner and outer walls. The container also has an upper open end for receiving a crayon or the like and a lower open end for dispensing the crayon or the like. The dispenser further has urging means for moving a crayon in a direction outwardly through the container at the lower open end. Other objects and features will be in part apparent and in part pointed out hereinafter.

BRIEF DESCRIPTIONS OF THE DRAWINGS

Corresponding reference characters indicate corresponding parts throughout the several views of the drawings.

DESCRIPTION OF THE PREFERRED EMBODIMENT

Figure 1:
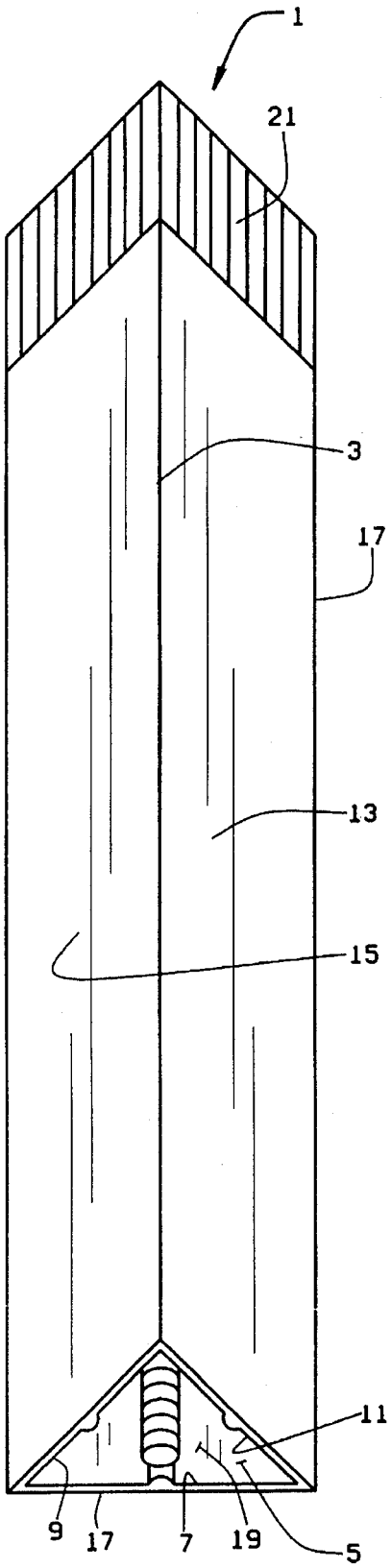
FIG. 1 is a prospective of a crayon dispenser of the present invention.

The drawings generally depict at 1 a crayon dispenser of this invention. Referring specifically to FIG. 1, the dispenser has a container 3 with a longitudinally extending passageway 5 therethrough. The container is triangular shaped for reasons which will be explained later but it can be of other shapes. The container has inner walls 7, 9 and 11 and outer walls, 13, 15 and 17. The container further has an upper end opening (not shown) which may be used for receiving a crayon or the like and a lower end opening 19 for dispensing the crayon or the like all of which will be understood later.

Figure 2:
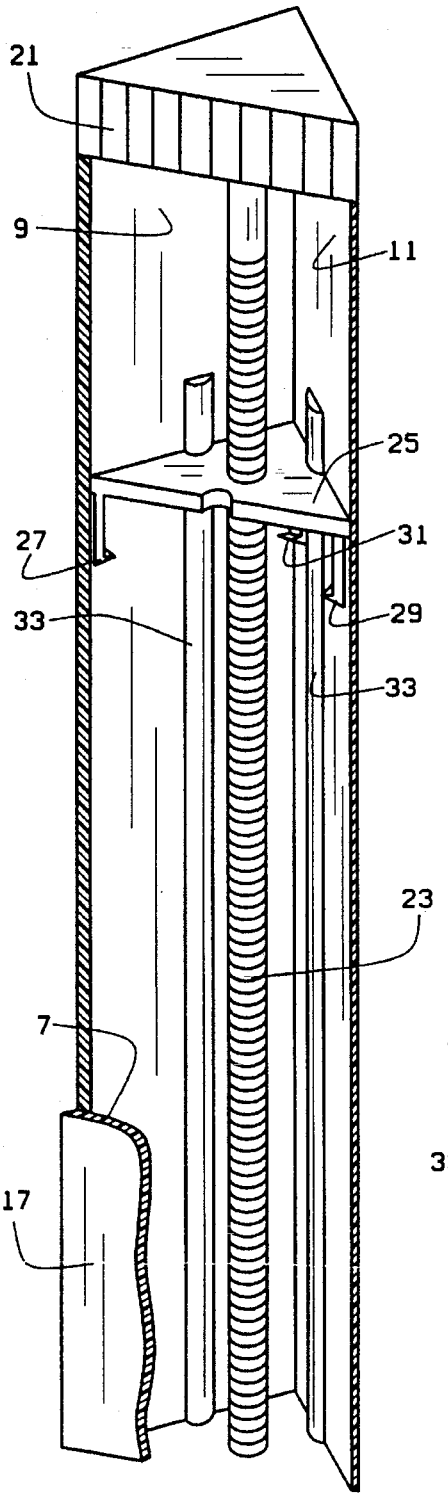
FIG. 2 is a section of the dispenser shown in FIG. 1 taken generally along line 2—2 of FIG. 1.

Referring now to FIG. 2, a screw head 21 is shown in the upper end opening of the container with a downwardly extending threaded shaft or loading rod 23 and a movable base 25, constituting means for urging the crayon out of said container as will be understood by those familiar in the art and explained later in more detail. By turning the screwhead counterclockwise, the base can be moved down the threaded shaft. Cartridge locks or detents 27, 29 and 31 are at the corners of the base and constitute means for securing a crayon cartridge in place.

Figure 3:
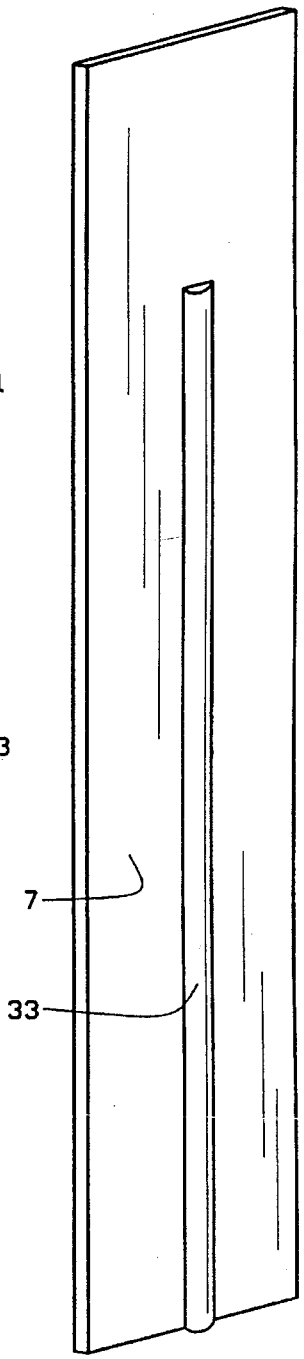
FIG. 3 is a partial sectional view of the inner wall of a side of the invention.

As shown more particularly in FIG. 3, a cartridge guide or rib 33 is on each inner wall (wall 7 is shown) to assist in the loading of cartridges.

Although now shown, it will be understood by those familiar in the art that a crayon cartridge also is used with this invention. The cartridge is essentially triangularly shaped crayon when is designed to fit in the passageway of container 3. The crayon cartridge has a hole therein which will correspond to the loading rod 23.

In operation, a crayon cartridge is inserted either through the lower open end of the container or the screwhead, base, and loading rod maybe removed and the cartridge inserted thereon and locked in place by the cartridge locks. If removed, the screwhead, base and loading rod with the cartridge are then inserted into the container through the upper end opening. It also will be understood that the hole in the crayon cartridge will receive the loading rod. The base 25 will be positioned near the screwhead. As the screwhead is turned, it will move the base downward and thus push the crayon cartridge out as needed. Thus, practically the entire crayon may be used since it will be held in the dispenser.

It will be further understood that the container is made of a durable plastic material. The cartridge guides on the inside of the container guide the crayon through and absorb heat from the hand.

In order to refill the dispenser if there is any crayon remaining or to change crayon color, one only need to tilt two of the cartridge locks backward, turn the dispenser upside down and shake it out.

In view of the above, it will be seen that the several objects of the invention is achieved and other advantageous results obtained.

As various changes could be made in the above construction without departing from the scope of this invention, it is intended that all matter contained in the above-description or shown in the accompanied drawings shall be interpreted as illustrative and not as a limiting sense.

I claim:

1. A dispenser for crayons or the like comprising a container having a longitudinally extending passageway therethrough with inner and outer walls, an upper open end and lower open end for dispensing the crayon or the like, said container having longitudinally extending ribs on each inner wall;

a crayon cartridge having a longitudinal bore through the center thereof;

urging means for moving a crayon in a direction outwardly through the container and the lower open end, said urging means having a head, a downwardly extending threaded shaft and a movable base positioned on said shaft for pressing said crayon cartridge out of said container, said container and base being triangular in shape; and means for securing said cartridge in the container, said means consisting of downwardly depending legs with detents to releasibly attach onto the cartridge during refilling of the dispenser.

* * * * *